United States Patent [19]

Koch et al.

[11] 4,149,849

[45] Apr. 17, 1979

[54] PROCESS FOR PRINTING AND DYEING

[75] Inventors: Robert Koch, Leichlingen; Otto Berenstecher, Bensberg; Horst Renziehausen; Heinz Gutjahr, both of Leverkusen, all of Fed. Rep. of Germany

[73] Assignee: Bayer Aktiengesellschaft, Leverkusen, Fed. Rep. of Germany

[21] Appl. No.: 853,863

[22] Filed: Nov. 22, 1977

[30] Foreign Application Priority Data

Nov. 24, 1976 [DE] Fed. Rep. of Germany ..... 2653418

[51] Int. Cl.[2] ..... C09B 65/00; D06P 5/02

[52] U.S. Cl. ..... 8/31; 8/21 C; 8/30; 8/54.2; 8/74; 8/100 R; 8/188; 8/189; 544/60; 544/147; 546/207

[58] Field of Search ..... 8/30, 100 R, 74, 188, 8/189, 31

[56] References Cited

U.S. PATENT DOCUMENTS

| | | | |
|---|---|---|---|
| 2,876,217 | 3/1959 | Paschall | 260/2 EP |
| 2,995,513 | 8/1961 | Paschall et al. | 536/50 |
| 4,035,145 | 7/1977 | Gipp et al. | 8/74 |

FOREIGN PATENT DOCUMENTS

| | | |
|---|---|---|
| 737603 | 2/1970 | Belgium. |
| 775295 | 3/1972 | Belgium. |
| 825476 | 8/1975 | Belgium. |
| 2117182 | 10/1972 | Fed. Rep. of Germany. |
| 2061533 | 6/1971 | France. |
| 7006834 | 11/1970 | Netherlands. |

*Primary Examiner*—A. Lionel Clingman
*Attorney, Agent, or Firm*—Plumley and Tyner

[57] ABSTRACT

A process for printing and dyeing textile materials consists in treating in the absence of alkali, with an epoxide of the general formula

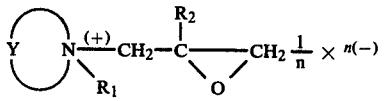

in which

Y represents a member for the completion of a 5-membered to 7-membered ring, $R_1$ represnts a $C_1$–$C_4$-alkyl group or a $C_2$–$C_4$-alkyl group which is substituted by an OH group, preferably the methyl group, $R_2$ represents hydrogen or methyl, $X^{n(-)}$ represents an anion and n represents 1, 2 or 3, and, after the latter has been fixed, in dyeing with an anionic dyestuff by known methods.

3 Claims, No Drawings

PROCESS FOR PRINTING AND DYEING

The subject of the invention is a process for printing and dyeing textile materials. The process is characterised in that the textile material is treated, in the absence of alkali, with an epoxide of the general formula

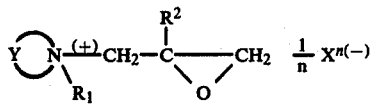

(I)

in which

Y represents a member for the completion of a 5-membered to 7-membered ring, $R_1$ represents a $C_1$–$C_4$-alkyl group or a $C_2$–$C_4$-alkyl group which is substituted by an OH group, preferably the methyl group, $R_2$ represents hydrogen or methyl, $X^{n(-)}$ represents an anion and n represents 1, 2 or 3, and, after the latter has been fixed, is dyed with an anionic dyestuff by known methods.

Those compounds of the formula (I) in which Y, conjointly with the nitrogen, forms a 5-membered or 6-membered ring, for example a pyrrolidine, piperidine or thiamorpholine ring and preferably a morpholine ring, are preferred. The rings can also carry substituents, for example methyl groups.

In particular, $R_1$ represents methyl and $R_2$ represents hydrogen or methyl.

The following examples of representatives of compounds of the formula (I) may be mentioned: N-methyl-N-(2,3-epoxypropyl)-morpholinium chloride, N-ethyl-N-(2,3-epoxy-2-methylpropyl)-thiamorpholinium chloride, N-butyl-N-(2,3-epoxypropyl)-piperidinium bromide, N-methyl-N-(2,3-epoxypropyl)-pyrrolidinium chloride, N-methyl-N-(2,3-epoxypropyl)-morpholinium p-toluene-sulphonate, N-2-hydroxyethyl-N-(2,3-epoxypropyl)-morpholinium chloride, N-methyl-N-(2,3-epoxypropyl)-morpholinium methosulphate and N-ethyl-N-(2,3epoxy-2-methyl-propyl)-morpholinium ethosulphate.

The compounds of the formula (I) can be prepared by various processes which are in themselves known (see, for example, Houben-Weyl, Methoden der Organischen Chemie ("Methods of Organic Chemistry"), volume XI/2, page 611, 4th edition 1968; French Patent Specification No. 1,450,083, DT-OS (German Published Specification) No. 2,056,002, DT-OS (German Published Specification) No. 2,407,147 and U.S. Pat. No. 3,737,406.

The compounds of the formula (I) which are to be used in accordance with the invention are preferably prepared by quaternising tertiary amines of the formula

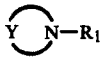

(II)

in which Y and $R_1$ have the meaning indicated under formula (I), with epoxy compounds of the formula

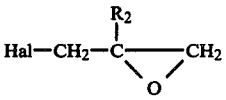

(III)

in which $R_2$ has the meaning indicated under formula (I) and Hal represents a halogen atom, preferably a chlorine or bromine atom.

Suitable anions $X^{n(-)}$ are anions both of inorganic acids, for example the chloride, bromide, sulphate or phosphate ion, and of organic acids, for example aromatic or lower aliphatic sulphonic acids, such as the benzenesulphonate, p-toluenesulphonate, methanesulphonate or ethanesulphonate ion, and also the anions of acid alkyl esters of inorganic acids, such as the methosulphate ion and the ethosulphate ion.

Suitable textile materials are slivers, yarns or sheet-like structures, such as woven fabrics, knitted fabrics or nonwovens composed of natural and synthetic materials containing polyamide or hydroxyl groups, such as cellulose fibres and regenerated cellulose fibres, synthetic polyamides, wool, silk or mixtures of the said fibres with one another or with, for example, polyester, polyacrylonitrile or triacetate fibres. Materials which are preferred for treatment are cellulose fibres and synthetic polyamide fibres.

The anionic dyestuffs which can be used preferentially by the process according to the invention are known under the designations of direct, acid, reactive and vat dyestuffs.

Examples of these dyestuffs are described in the Colour Index, 3rd edition (1971):

Direct dyestuffs in volume 2, pages 2,007–2,477,
Acid dyestuffs in volume 1, pages 1,003–1,561,
Reactive dyestuffs in volume 3, pages 3,395–3,559 and
Vat dyestuffs in volume 3, pages 3,727–3,837.

The treatment of the fibres with the compounds of the formula (I) is carried out in such a way that the textile materials are printed or padded by known processes, in the absence of alkali, with aqueous liquors which contain the compounds (I), preferably in a quantity of 5–100 g/kg, in particular 10–60 g/kg, of printing paste or 5–100 g/l, in particular 10–60 g/l, of padding liquor.

The printing pastes contain conventional thickeners, for example of the galactomannan or alginic acid series, carboxymethylcellulose or hydroxyethylcellulose, starch ethers or natural gums.

The fibre material which has been pretreated in this way is submitted, optionally after squeezing out to a specific liquor pick-up, for example to 60–100%, and/or after drying at temperatures between 70° and 140° C., to a heat treatment to effect fixing. Fixing can also be carried out by a cold pad-batch process.

The heat treatment can be effected by steaming for a short period, for example by steam treatment at 102° to 120° C. for 2 to 10 minutes, or by treatment with dry heat for a short period, for example 1 to 15 minutes at 120° to 190° C., in particular at up to 150° C. The pad-batch process is carried out by rolling up the material which has been impregnated and squeezed out and storing it at room temperature for 4 to 24 hours. Care must be taken, by wrapping with water-impermeable material, that water cannot evaporate.

Subsequently to fixing, dyeing is carried out with the anionic dyestuffs which are suitable for the particular fibre material. Dyeing can be carried out by known discontinuous, partly continuous or fully continuous processes under the conditions which are suitable for the dyestuff employed.

The liquor ratio can be 1:4 to 1:50.

When dyeing with reactive dyestuffs it is possible to dispense with the alkali required for application by known processes.

The prints and dyeings which are obtained by the process according to the invention are distinguished by a special depth of colour, high brilliance and good fastness properties.

The treatment of the fibre materials with fixing agents has hitherto been carried out in the presence of alkali. It has now been found, surprisingly, that an excellent fixing of the compounds (I) is obtained in the absence of alkali even at the relatively low temperatures described above. It has, on the contrary, been necessary to assume that serviceable fixing is achieved at high temperatures above 200° C. However, at these temperatures damage is already caused to certain fibres. Many fibres have a tendency to yellowing at high temperatures. In the process according to the invention, however, the fibres are not attacked in this manner.

A further advantage of the process according to the invention consists in the fact that the alkali-free printing pastes and dye liquors have a significantly higher stability than the corresponding alkali-containing printing pastes and dye liquors.

The depth of colour of the subsequent dyeing can be varied depending on the concentration of the fixing agents (I) on the fibre. In the printing field it is possible to obtain excellent tone-in-tone effects in a simple manner by printing with different concentrations of the compounds (I). The areas of the textile material which have not been printed with the fixing agent remain pure white in the subsequent dyeing with reactive dyestuffs, because alkali is absent. When dyeing with the remaining anionic dyestuffs these areas are dyed in very pale shades. As a result, it is possible to dye these untreated areas in other colours by means of representatives of other groups of dyestuffs which have been printed on in the same operation as the compound (I). All dyestuffs which can readily be fixed by means of hot air, such as coloured pigments, the binders of which are crosslinked under hot conditions by means of salts which split off acid, and also phthalocyanine dyestuffs or their preproducts (amino-imino-isoindolenine), reactive dyestuffs and developing dyestuffs are suitable for this process, as are also naphthols on their own, if the diazotised, or diazotised and stabilised, diazo component is subsequently, that is to say before introduction into the dye bath, applied to the goods.

In the case of these anionic dyestuffs, the substantivity and rate of absorption of which is regulated by addition of electrolyte (Na sulphate or Na chloride), omission of this addition of salt can lead to an enhancement of the difference in depth of colour between printed and unprinted areas.

Because the dyestuffs are excellently fixed in the process according to the invention, the dyeing times are shortened and the rinsing baths are only slightly coloured or not at all, so that pollution of the effluent is low.

The five-digit Colour Index numbers quoted in the examples which follow relate to the data in the Colour Index, 3rd edition (1971), volume 4; the other dyestuffs used are described in the Colour Index, 3rd edition (1971), volume 2.

EXAMPLE 1

A cotton fabric which has been pretreated for printing, that is to say kier-boiled and bleached, is printed according to a pattern in the roller printing process, with two pastes which have the following composition:

| Paste 1 | Paste 2 | |
|---|---|---|
| 10 g | 50 g | of N-methyl-N-(2,3-epoxypropyl)-morpholinium chloride |
| 490 g | 450 g | of water |
| 500 g | 500 g | of a 10% strength aqueous solution of a galactomannan |
| 1,000 g | 1,000 g | |

The material is then dried at approximately 80° C. and treated with hot air at 150° C. for 5 minutes in a curing chamber. After this pretreatment, the material can be completely dyed on a winch beck in an aqueous liquor of the dyestuff of the formula

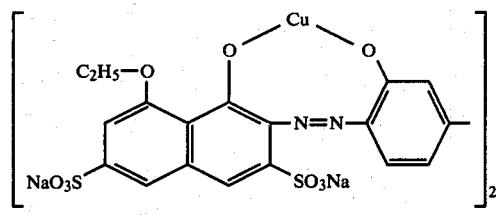

(1% strength relative to the weight of the goods). Dyeing is begun here at 40° C., the temperature is raised to 95° C. in the course of 30 minutes and dyeing is continued for a further 45 minutes at this temperature. The material is then cold-rinsed and soaped for 5 minutes at the boil.

A dyeing with good fastness to wet processing and light is obtained which is pale blue on the unprinted areas, medium blue on the areas printed with 10 g/kg of product and dark blue on the areas printed with 50 g/kg.

Dyeings in various depths of colour which have equally good properties are obtained if the following dyestuffs:

Direct Yellow—C.I. 106
Direct Red—C.I. 218
Direct Red—C.I. 212
Direct Blue—C.I. 243
Direct Blue—C.I. 199
Direct Green—C.I. 68
Direct Green—C.I. 23
Direct Orange—C.I. 40
Direct Black—C.I. 112 are employed instead of the dyestuff mentioned and if the following compounds: N-methyl-N-(2,3-epoxypropyl)-thiamorpholinium chloride, N-methyl-N-(2,3-epoxypropyl)-piperidinium chloride or N-methyl-N-(2,3-epoxypropyl)-pyrrolidinium methosulphate are employed instead of the morpholinium chloride.

EXAMPLE 2

A pre-washed, made-up, white cotton knitted fabric is printed according to a pattern by means of screen-printing stencils using the following pastes:

| Paste 1 | 2 | 3 | |
|---|---|---|---|
| 15 g | 40 g | — | of the morpholinium chloride of Example 1 |
| — | — | 40 g | of the red dyestuff according to U.S. Pat. Specification 3,853,840, Example 18 |
| — | — | 100 g | of urea |
| — | — | 20 g | of Na bicarbonate |
| 485 g | 460 g | 340 g | of water |
| 500 g | 500 g | 500 g | of a 4% strength aqueous Na alginate thickener |
| 1,000 g | 1,000 g | 1,000 g | |

After printing, the goods are dried at approximately 90° C., thermofixed for 5 minutes in an atmosphere of hot air at approximately 150° C. and dyed completely on a paddle dyer as follows:

The goods are introduced at approximately 25° C. into the dye bath which contains 1.5% (relative to the weight of the goods) of the yellow dyestuff according to U.S. Pat. No. 3,666,747, Example 206, dyeing is carried out for 20 minutes at a temperature rising to 40° C., 20 g of calcined sodium carbonate per dye bath are then added, as a solution, and dyeing is continued for a further 30 minutes. After rinsing the goods are soaped as usual at the boil.

A very fast, golden-yellow dyeing is obtained which contains deeper golden-yellow shades on the printed areas in proportion to the concentration of morpholinium chloride in the printing pastes 1 and 2 as well as red effects which also have a very good level of fastness on the areas printed with paste 3.

Equally good effects are obtained if Reactive Red C.I. 153 and Reactive Red C.I. 82 are used instead of the red dyestuff in the printing paste and if Reactive Yellow C.I. 25 is used instead of the yellow dyestuff in the dyeing.

In all these cases the products listed in Example 1 can also be employed instead of the morpholinium chloride for deepening the colour locally.

EXAMPLE 3

The goods which have been pre-printed and fixed as in Example 2 are treated further in the following way.

The goods are introduced at 40° C. into a dyebath which contains 2% (relative to the weight of the goods) of the dyestuff according to U.S. Pat. No. 3,669,951, Example 325, the temperature is increased to 95° C. in the course of 30 minutes and dyeing is continued for a further 45 minutes at this temperature. Since no alkali has been used during dyeing, unprinted areas remain uncoloured. Only the areas which have been printed with the morpholinium chloride are dyed navy blue; specifically, they are dyed the more deeply, the more of this product has previously been applied to these areas. The adjacent printing effect in other colours is only slightly tinted by the cross-dyeing. These effects also are extremely fast.

Equally good effects are obtained in turn, if, instead of the dyestuff, the dyestuffs which follow are used on their own or mixed with one another:

Reactive Blue—C.I. 120
Reactive Orange—I.C. 62
Reactive Red—C.I. 119
Reactive Violet—C.I. 33
Reactive Black—C.I. 34

Similarly, the morpholinium chloride can be replaced by the products enumerated in Example 1.

EXAMPLE 4

A white, previously cleaned polyamide knitted fabric is printed in a single colour by the rotary screen-printing process, using a cocksfoot pattern and printing paste which contains, besides thickener (an approximately 10% strength aqueous solution of a guar derivative) and water, 60 g of the morpholinium chloride of Example 1 per kg. The goods are dried at approximately 120° C. and are thermofixed for 5 minutes at 150° C. Dyeing is then carried out on a jet dyeing apparatus under normal conditions (acidified to pH 6 with acetic acid) using 2% (relative to the weight of the goods) of Acid Orange C.I. 99 (C.I. 12696).

An orange dyeing is obtained in which the printed motifs are rendered visible in about twice the depth of colour compared with the unprinted areas, without the fastness properties known for this dyestuff being impaired.

Equally good effects are obtained, if, instead of Acid Orange C.I. 99, dyeing is carried out with the following dyestuffs or mixtures thereof:

Acid Blue—C.I. 264
Acid Red—C.I. 360
Acid Red—C.I. 299
Acid Brown—C.I. 331
Acid Green—C.I. 92

Furthermore, as in the previous examples, the other products from Example 1 can also be employed instead of the morpholinium chloride.

EXAMPLE 5

If the treatment of Example 4 is altered in such a way that, when dyeing, not merely the said acid dyestuffs or mixtures thereof are used in the dye bath, but also disperse dyestuffs which are suitable for polyamide, such as:

Disperse Blue—C.I. 7
Disperse Blue—C.I. 93
Disperse Yellow—C.I. 74
Disperse Orange—C.I. 47
Disperse Red—C.I. 201
Disperse Red—C.I. 105
Disperse Violet—C.I. 51 two-colour effects are obtained, since the nonionic disperse dyestuffs do not react with the first printing with epoxide. In this case too, fastness properties are obtained which are equal to those of dyeings obtained without a previous printing.

EXAMPLE 6

A viscose staple rayon fabric which has been pretreated for printing is printed according to a pattern in the flat film printing process, that is to say with screen-printing stencils, using several concentrations of the morpholinium chloride of Example 1 in an aqueous solution of galactomannan and simultaneously using the following accessory dyestuffs:

As black a ground pigment which is based on carbon black and which is fixed by means of an ABS binder, as brilliant red the developing dyestuff obtained from the diazoamido compound formed from 4-chloro-2-toluidine/methylamidoacetic acid and Naphthol-AS-PH, as brilliant blue, Ingrain Blue C.I. 5 (C.I. 74161:2) and as brilliant yellow the dyestuff according to U.S. Pat. No. 3,853,840, Example 206, all according to printing instructions which are in themselves known.

After drying at 80°-90° C., the material is thermofixed for 10 minutes at 140° C. in a curing chamber and dyeing is then carried out without addition of alkali on a jig using the dyestuff according to U.S. Pat. No. 3,669,951, Example 25, as has already been described in Example 3.

After dyeing, soaping and drying a multi-coloured design corresponding to the above layout is obtained, the unprinted areas appearing white and the figures which have been printed with the morpholinium chloride in various concentrations appearing in blue shades of varying depth.

Equally good effects are obtained if, for the accessory dyestuffs, other dyestuffs, such as:
Pigment Yellow—C.I. 16
Pigment Red—C.I. 112
Pigment Violet—C.I. 23
Pigment Blue—C.I. 15
Pigment Green—C.I. 7
are used instead of Pigment Black, if dyestuffs, such as:
Azoic Blue—C.I. 6
Azoic Red—C.I. 16
Azoic Yellow—C.I. 11
Azoic Green—C.I. 1
Azoic Black—C.I. 4
are used instead of the red developing dyestuff, if dyestuffs, such as:
Ingrain Blue—C.I. 2
Ingrain Blue—C.I. 15
Ingrain Blue—C.I. 7
Ingrain Brown—C.I. 1
are used instead of Ingrain Blue C.I. 5 and if dyestuffs, such as:
Reactive Yellow—C.I. 10
Reactive Orange—C.I. 41
Reactive Red—C.I. 81
Reactive Blue—C.I. 29
Reactive Blue—C.I. 104
are used instead of the yellow dyestuff.

In this example too—as in Example 3—it is, of course, possible to replace the reactive dyestuffs for the dyeing and—as in Example 1—to replace the products in the place of the morpholinium chloride for the colour-deepening effect.

All these printing effects have good fastness to light and stand up to washing at the boil.

EXAMPLE 7

If a viscose plush (usually with a viscose pile and a cotton ground fabric) is used instead of the cotton fabric specified in Example 1 which has been pretreated for printing, it is possible to produce, in an outstanding manner, imitations of animal hides for outerwear articles by printing, according to a pattern, several concentrations of N-methyl-N-(2,3-epoxypropyl)-morpholinium chloride or of one of the compounds also specified in Example 1, the dyestuffs:
Direct Brown—C.I. 106 (C.I. 36200)
Direct Brown—C.I. 100 (C.I. 35800)
Direct Orange—C.I. 40 (C.I. 40265)
Direct Black—C.I. 77 (C.I. 35860)
Direct Yellow—C.I. 106 (C.I. 40300)
on their own or as mixtures with one another, being preferred for the dyeing.

The punctiform, speckled or striped patternings of the particular animal hides which are to be imitated are obtained in natural shades, and it is possible to achieve an improvement in the fastness to wet processing of the bottom shade by treating the latter with commercially available cationic polyammonium compounds (2% relative to the weight of the goods), for example for 20 minutes at 40° C. in aqueous solution, as a final operation.

EXAMPLE 8

Dyeing by means of vat dyestuffs, after the preliminary treatment of the goods which is described in Example 1, is also suitable for the production of articles composed of pure cotton which have good fastness to light and washing, or of mixed fabrics which are composed of polyester fibres together with cotton and in which the polyester proportion can remain undyed. In analogy to the effects displayed with direct dyestuffs in Example 1, tone-in-tone effects are also achieved using the following dyestuffs:
Vat Yellow C.I. 26 (C.I. 65410)
Vat Orange C.I. 15 (C.I. 69025)
Vat Brown C.I. 3 (C.I. 69015)
dyeing being preferably carried out in a jig, on a winch beck or on a paddle dyer and without a special addition of electrolyte. In this case too, the products mentioned in Example 1 in the place of N-methyl-N-(2,3-epoxypropyl)-morpholinium chloride are suitable for the production of equally good effects.

EXAMPLE 9

A cotton fabric is padded at room temperature with a liquor which contains, per liter, 40 g of N-methyl-N-(2,3-epoxypropyl)-morpholinium chloride, 1 g of monosodium di-(2-ethyl-hexyl) phosphate and 1 g of ethylene glycol. The fabric is squeezed out to an increase in weight of 80%, dried and thermofixed for 3 minutes at 150° C. The fabric is then padded at room temperature with a liquor which contains, per liter, 20 g of C.I. Direct Blue 78 (C.I. 34200).

The fabric is squeezed out to an increase in weight of 80%, rolled up, wrapped in a film and kept at room temperature for 16 hours.

It is then given a cold and a hot rinse. A blue dyeing with outstanding fastness properties is obtained.

The epoxides mentioned in Example 1 can also be used instead of the morpholinium chloride.

EXAMPLE 10

A cotton fabric is padded at room temperature with a liquor which contains, per liter, 50 g of N-methyl-N-(2,3-epoxypropyl)-morpholinium chloride, 1 g of monosodium di-(2-ethyl-hexyl) phosphate and 1 g of ethylene glycol. The fabric is squeezed out to an increase in weight of 80%, dried and thermofixed for 2 minutes at 150° C. It is then padded at room temperature with a liquor which contains, per liter, 15 g of the dyestuff according to U.S. Pat. No. 3,669,951, Example 64 (Ni complex).

The fabric is squeezed out to an increase in weight of 80% and is steamed at 103° C. for 3 minutes.

It is then given a cold and a hot rinse. This gives a brilliant green dyeing with outstanding fastness to water, perspiration and washing.

The epoxides mentioned in Example 1 can also be used instead of the morpholinium chloride.

EXAMPLE 11

A cotton fabric is padded at room temperature with a liquor which contains, per liter, 40 g of N-methyl-N-(2,3-epoxypropyl)-morpholinium chloride, 1 g of monosodium di-(2-ethyl-hexyl) phosphate and 1 g of ethylene glycol. The fabric is squeezed out to an increase in weight of 90%, dried and thermofixed for 3 minutes at 150° C. It is then padded with a liquor which contains, per liter, 12 g of C.I. Direct Black 77 (C.I. 35860).

The fabric is squeezed out to an increase in weight of 80%, dried and thermofixed for 2 minutes at 150° C.

It is then given a cold and a hot rinse. This gives a grey dyeing with very good fastness to water, perspiration and washing.

The epoxides mentioned in Example 1 can also be used instead of the morpholinium chloride.

EXAMPLE 12

A cotton fabric is padded at room temperature with a liquor which contains, per liter, 50 g of N-methyl-N-(2,3-epoxypropyl)-morpholinium chloride, 1 g of monosodium di-(2-ethyl-hexyl) phosphate and 1 g of ethylene glycol. The fabric is squeezed out to an increase in weight of 80%, dried and thermofixed for 1 minute at 180° C.

Dyeing is then carried out for 45 minutes at 25°-90° C. with a liquor ratio of 1:15 using 1% of the dyestuff according to U.S. Pat. No. 3,669,951, EXAMPLE 325. The fabric is then given a cold and a hot rinse.

A blue dyeing with outstanding fastness to water, perspiration and washing is obtained.

EXAMPLE 13

A cotton fabric is padded at room temperature with a liquor which contains, per liter, 60 g of N-methyl-N-(2,3-epoxypropyl)-morpholinium chloride, 1 g of monosodium di-(2-ethyl-hexyl) phosphate and 1 g of ethylene glycol. The fabric is squeezed out to an increase in weight of 80%, dried and thermofixed for 2 minutes at 150° C.

Dyeing is then carried out for 60 minutes at 30°-95° C. with a liquor ratio of 1:20 using 1% of C.I. Direct Green 34 (C.I. 27970). The fabric is then given a cold and a hot rinse.

A green dyeing with very good fastness to water, perspiration and washing is obtained.

EXAMPLE 14

A mixed fabric composed of polyester/cotton (66:33) is padded at 25° C. with a liquor which contains, per liter, 30 g of the disperse dyestuff, C.I. Disperse Red 17 (C.I. 11210), 40 g of N-methyl-N-(2,3-epoxypropyl)-morpholinium chloride, 0.5 g of monosodium di-(2-ethyl-hexyl) phosphate, 0.5 g of ethylene glycol and 10 g of sodium polyacrylate. The fabric is dried and given a thermosol treatment for 1 minute at 200° C.

It is then padded with a liquor which contains, per liter, 15 g of the dyestuff of Example 13.

The fabric is rolled up, wrapped with film and left to stand for 16 hours at room temperature.

It is then given a cold and a hot rinse. A blue-red bi-colour dyeing with good fastness to perspiration and very good fastness to washing is obtained.

We claim:

1. Process for printing and dyeing textile materials containing hydroxyl groups, characterised in that the textile material is treated, in the absence of alkali, with an expoxide of the general formula

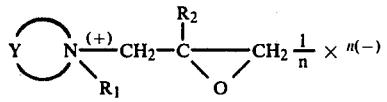

in which

Y represents a member for the completion of a 5-membered to 7-membered ring, $R_1$ represents a $C_1$–$C_4$ alkyl group or a $C_2$–$C_4$-alkyl group which is substituted by an OH group, $R_2$ represents hydrogen or methyl, $X^{n(-)}$ represents an anion and n represents 1, 2 or 3, and, after the latter has been fixed, is dyed with an anionic dyestuff.

2. Process according to claim 1, characterised in that the epoxide is applied to the textile material by a printing or padding process.

3. Process according to claim 1, characterised in that a compound of the formula shown in claim 1, in which Y represents a member for the completion of a pyrrolidine, piperidine, morpholine or thiamorpholine ring, $R_1$ represents methyl and $R_2$ represents hydrogen or methyl is used as the epoxide.

* * * * *